US010857434B1

(12) United States Patent
Dearing, Jr.

(10) Patent No.: US 10,857,434 B1
(45) Date of Patent: Dec. 8, 2020

(54) GOLF BALL MARKER DISPENSER

(71) Applicant: Michael Wayne Dearing, Jr., Houston, TX (US)

(72) Inventor: Michael Wayne Dearing, Jr., Houston, TX (US)

( * ) Notice: Subject to any disclaimer, the term of this patent is extended or adjusted under 35 U.S.C. 154(b) by 0 days.

(21) Appl. No.: 16/512,272

(22) Filed: Jul. 15, 2019

(51) Int. Cl.
*A63B 57/50* (2015.01)
*A63B 57/30* (2015.01)
*A45F 5/02* (2006.01)
*A63B 57/20* (2015.01)

(52) U.S. Cl.
CPC ..... *A63B 57/207* (2015.10); *A45F 5/021* (2013.01); *A63B 57/353* (2015.10)

(58) Field of Classification Search
CPC ..... A63B 57/207; A45C 2001/102; A45C 2001/104; A45C 2001/105; A45C 2001/107; A45C 2001/108; G07D 9/002
USPC ..... 224/918; 453/54
See application file for complete search history.

(56) References Cited

U.S. PATENT DOCUMENTS 986,158 A 3/1911 Florsheim
1,432,498 A * 10/1922 Szepe ..... A45C 1/02 453/54
2,178,872 A 11/1939 Engstrom
2,181,806 A * 11/1939 Fulton ..... A45C 1/024 453/54
2,261,959 A * 11/1941 Buttikofer ..... A63B 57/207 473/285
2,644,471 A * 7/1953 Brown ..... A45C 1/02 453/50
3,393,688 A * 7/1968 Saverino ..... G07D 9/002 453/51
3,731,695 A * 5/1973 Meijer ..... A45C 1/10 453/54
3,996,766 A * 12/1976 Welch ..... A44C 25/002 63/1.14
4,099,532 A * 7/1978 Mascherin ..... G07D 1/08 453/54
D252,422 S 7/1979 Gillenwater
4,239,216 A * 12/1980 Bauer ..... A63B 57/00 473/285
D289,217 S * 4/1987 Murphy ..... D99/34
(Continued)

FOREIGN PATENT DOCUMENTS

GB 1369506 A 10/1974
JP 2005348773 A 12/2005
(Continued)

*Primary Examiner* — Justin M Larson
(74) *Attorney, Agent, or Firm* — Quisenberry Law PLLC

(57) ABSTRACT

A golf ball marker dispenser may include a housing having an inner compartment with an opening in a front wall of the housing. The housing may include a rectangular slot in a top wall of the housing through which a golf ball marker may be inserted and retrieved. The dispenser may include a spring having a relaxed position and an engaged position. The spring is in its relaxed position when the golf ball marker is not housed within the dispenser, and in its engaged position when the golf ball marker is housed within the dispenser. The spring pushes the golf ball marker toward the front wall into engagement with an inner surface of the front wall. The golfer inserts his or her finger through the opening in the front wall and into contact with the golf ball marker to then slide it upwardly for removal through the slot.

36 Claims, 2 Drawing Sheets

(56) References Cited

U.S. PATENT DOCUMENTS

D296,156 S 6/1988 Deany et al.
4,798,319 A * 1/1989 James, Jr. ..... A63B 47/001 224/251
4,836,365 A * 6/1989 Hall ..... G07D 1/08 206/0.8
4,972,557 A * 11/1990 Williams ..... A44B 11/005 224/163
5,492,504 A * 2/1996 Wolters ..... A45C 1/02 206/0.84
5,494,202 A * 2/1996 Wyatt ..... A63B 57/00 224/666
5,499,710 A * 3/1996 Hoffman ..... A45C 1/02 206/0.81
5,529,299 A 6/1996 Bellagamba
5,740,624 A * 4/1998 Baseley ..... A45C 11/182 40/27.5
5,782,280 A * 7/1998 Berry ..... A45C 1/02 150/112
6,053,310 A * 4/2000 Mandel ..... G07D 9/002 206/0.81
6,102,263 A * 8/2000 Rosato ..... A63B 47/001 224/196
6,200,226 B1 * 3/2001 Regan ..... A63B 57/353 473/223
6,302,777 B1 * 10/2001 Zoldan ..... A45C 1/10 221/132
D467,068 S 12/2002 Lewis
6,705,497 B1 3/2004 Schuett
7,004,858 B2 2/2006 Bauley et al.
7,828,670 B1 * 11/2010 Schroader ..... A63B 53/14 473/285
D652,101 S * 1/2012 Ward ..... D21/794
D831,145 S * 10/2018 Kuo ..... D21/796
2004/0004097 A1 * 1/2004 Seenauth ..... A63B 57/20 224/269
2004/0245122 A1 * 12/2004 Newenham ..... A45C 1/10 206/0.8
2007/0219023 A1 9/2007 Stanley
2008/0230435 A1 9/2008 Cope
2011/0009214 A1 1/2011 Steinberg
2013/0130823 A1 * 5/2013 Miller ..... A63B 57/353 473/285

FOREIGN PATENT DOCUMENTS

JP 2009254391 A 11/2009
WO WO 200810328 A1 1/2008

* cited by examiner

GOLF BALL MARKER DISPENSER

BACKGROUND OF THE INVENTIONS

1. Field of the Inventions

The present inventions generally pertain to the field of golf ball markers, and more particularly to a clip device for storage of a golf ball marker when it is not in use and retrieval of the golf ball marker when it is needed for play.

2. Description of the Related Art

As is well known to golfers, when on a putting green the golfer will place a ball marker (e.g., a coin such as a quarter or other ball marking device) just behind the golfer's ball, and then pick the golf ball up while the golfer's playing partners are putting. When it is the golfer's turn to putt, the golfer will replace the golf ball in front of the golf ball marker, and then pick up the golf ball marker, at which point the golfer's golf ball is back in play.

Many golfers will keep their golf ball marker (e.g., coin) in their front pants pocket. When the golfer is on the green and in need of a golf ball marker, it is not uncommon for the golfer to take some time searching through his/her pants pocket for the ball marker, which can slow down the pace of play and cause frustration. A variety of golf ball marker dispensers or holders of golf-related objects that are attached in some way to a golfer or a golfer's equipment have been developed, many of which address this issue, examples of which are shown in the following materials: U.S. Pat. No. 986,158 to Florsheim entitled "Coin Receptacle"; U.S. Pat. No. 2,178,872 to Engstrom entitled "Golf Club Attachment and Marker"; U.S. Pat. No. 5,529,299 to Bellagamba entitled "Golf Accessory"; U.S. Pat. No. 6,705,497 to Schuett entitled "Holder/Dispenser for Golf Ball Markers"; U.S. Pat. No. 7,004,858 to Bauley et al. entitled "Golf Ball Marker Retainer and Divot Repair Device Combination"; United States Patent Application Publication No. US 2007/0219023 to Stanley entitled "C-Shaped Disk Holder"; United States Patent Application Publication No. US 2008/0230435 to Cope entitled "Golf Accessory Holder and Pivot Repair Tool"; United States Patent Application Publication No. US 2011/0009214 to Steinberg entitled "Golf Marker and Clip Assembly"; U.S. Pat. No. Des. 252,422 to Gillenwater entitled "Holder for Golf Ball Markers"; U.S. Pat. No. Des. 296,156 to Deany et al. entitled "Golf Ball Marker Holder"; U.S. Pat. No. D467,068 to Lewis et al. entitled "Clip-on Receiver for Supporting a Weighted Object on a User's Waist Belt"; Great Britain Patent Specification 1,369,506 to Samways; Japanese Published Application JP2005348773 to Shokai; Japanese Published Application JP2009254391 to Akihiko; and PCT Publication W0 2008/010428 to Akihiko entitled "Ball Marker Holder." The disclosures of these materials, however, do not adequately solve the above-described issue.

As will become apparent from the description and explanation set forth below, the present inventions overcome the above-described issue by providing a clip device that a golfer can easily clip to the golfer's belt, other item of clothing (e.g., a hat) or equipment, and that can store the golf ball marker and snuggly secure it within the clip device for easy retrieval and storage.

SUMMARY OF THE INVENTIONS

The present inventions generally relate, in one aspect, to a golf ball marker dispenser comprising: a housing including a bottom wall, a left side wall, a right side wall, a top wall, a back wall, and a front wall having an opening, the front wall having an inner surface; a clip attached to back wall of the housing; a spring secured to the housing and disposed within an inner compartment of the housing; the top wall of the housing including a rectangular slot through which a golf ball marker may be inserted into and removed from the inner compartment; and, the spring having a relaxed position and an engaged position, the spring being in contact with the golf ball marker when the golf ball marker is housed within the inner compartment of the housing and pushing the golf ball marker against the inner surface of the front wall when in the spring is in its engaged position, and the spring extending into a space in the form of a rectangular prism directly below the rectangular slot in the top wall when the golf ball marker is not housed within the inner compartment of the housing and the spring is in its relaxed position. Another feature of this aspect of the present inventions is that the opening in the front wall may define a lip around the opening and the spring pushes the golf ball marker against the lip when the golf ball marker is housed within the inner compartment of the housing. Another feature of this aspect of the present inventions is that the opening may be in a geometric shape. Another feature of this aspect of the present inventions is that the opening may be in the shape of one of a square and a circle. Another feature of this aspect of the present inventions is that the clip may be formed as part of the housing. Another feature of this aspect of the present inventions is that the golf ball marker may be in the shape of a circular disc. Another feature of this aspect of the present inventions is that at least part of the spring may be positioned in the space defined by the opening in the front wall when the spring is in its relaxed position. Another feature of this aspect of the present inventions is that the rectangular slot may include a forward wall and a rearward wall, each of which may incline downwardly towards each other and toward an inner surface of the top wall, and the forward wall may be aligned with the inner surface of the front wall of the housing.

In another aspect, the present inventions may include a golf ball marker dispenser comprising: a housing including a bottom wall, a left side wall, a right side wall, a top wall, a back wall, and a front wall having an opening, the front wall having an inner surface; a clip attached to back wall of the housing; a spring secured to the housing and disposed within an inner compartment of the housing; the top wall of the housing including a rectangular slot through which a golf ball marker may be inserted into and removed from the inner compartment, the rectangular slot including a forward wall and a rearward wall, each of which inclines downwardly towards each other and toward an inner surface of the top wall, the forward wall of the rectangular slot being aligned with the inner surface of the front wall of the housing; and, the spring having a relaxed position and an engaged position, the spring being in contact with the golf ball marker when the golf ball marker is housed within the inner compartment of the housing and pushing the golf ball marker against the inner surface of the front wall when in the spring is in its engaged position, and the spring extending into a space in the form of a rectangular prism directly below the rectangular slot in the top wall when the golf ball marker is not housed within the inner compartment of the housing and the spring is in its relaxed position. Another feature of this aspect of the present inventions is that the opening in the front wall may define a lip around the opening and the spring pushes the golf ball marker against the lip when the golf ball marker is housed within the inner compartment of the housing. Another feature of this aspect of the present inventions is that the opening may be in a geometric shape. Another feature of this aspect of the present inventions is that the opening may be in the shape of one of a square and a circle. Another feature of this aspect of the present inventions is that the clip may be formed as part of the housing. Another feature of this aspect of the present inventions is that the golf ball marker may be in the shape of a circular disc. Another feature of this aspect of the present inventions is that at least part of the spring may be positioned in the space defined by the opening in the front wall when the spring is in its relaxed position.

In another aspect, the present inventions may include a golf ball marker dispenser comprising: a housing including a bottom wall, a left side wall, a right side wall, a top wall, a back wall, and a front wall having an opening, the front wall having an inner surface; a clip attached to back wall of the housing; a spring secured to the housing and disposed within an inner compartment of the housing; the top wall of the housing including a rectangular slot through which a golf ball marker may be inserted into and removed from the inner compartment; the spring having a relaxed position and an engaged position, the spring being in contact with the golf ball marker when the golf ball marker is housed within the inner compartment of the housing and pushing the golf ball marker against the inner surface of the front wall when in the spring is in its engaged position, and the spring extending into a space in the form of a rectangular prism directly below the rectangular slot in the top wall when the golf ball marker is not housed within the inner compartment of the housing and the spring is in its relaxed position; and the opening in the front wall defining a lip around the opening, the spring being adapted to push the golf ball marker against the lip when spring is in its engaged position and the golf ball marker is housed within the inner compartment of the housing. Another feature of this aspect of the present inventions is that the opening may be in a geometric shape. Another feature of this aspect of the present inventions is that the clip may be formed as part of the housing. Another feature of this aspect of the present inventions is that at least part of the spring may be positioned in the space defined by the opening in the front wall when the spring is in its relaxed position. Another feature of this aspect of the present inventions is that the rectangular slot may include a forward wall and a rearward wall, each of which may incline downwardly towards each other and toward an inner surface of the top wall, and the forward wall may be aligned with the inner surface of the front wall of the housing.

Other features, aspects and advantages of the present inventions will become apparent from the following discussion and detailed description.

Figure 1:
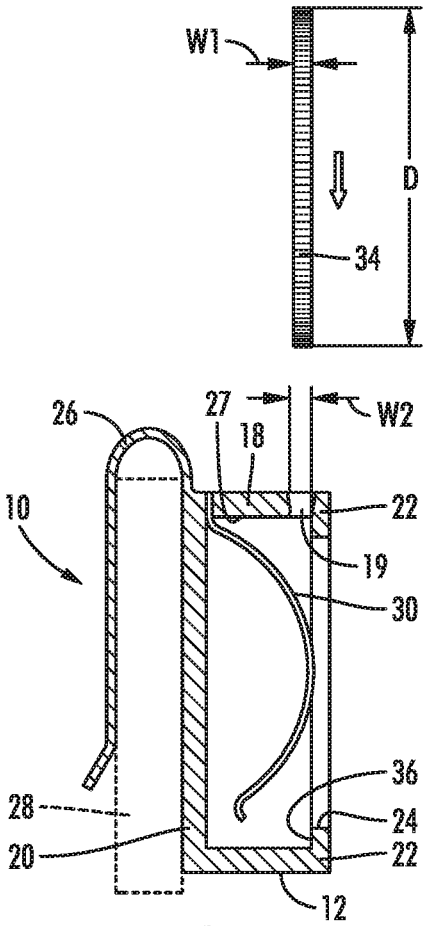
FIG. 1 is a side view showing a specific embodiment of a golf ball marker dispenser constructed in accordance with one aspect of the present inventions, and showing a golf ball marker being inserted into the top of the dispenser.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTIONS

Referring to the drawings in detail, wherein like numerals denote identical elements throughout the several views, and referring initially to FIGS. 1-4, there is shown a specific embodiment of a golf ball marker dispenser 10 comprising a generally rectangular housing 11 including a bottom wall 12, a left side wall 14, a right side wall 16, a top wall 18, a back wall 20, and a front wall 22 having an opening 24. In a specific embodiment, the opening 24 may be in a geometric shape, such as a square. In a specific embodiment, the golf ball dispenser 10 also include a clip 26 attached to the housing. In a specific embodiment, the clip 26 may be integrally formed with the housing 11. In a specific embodiment, the clip 26 may be for attaching the golf ball marker dispenser 10 to a belt 28, as shown, for example, in dashed lines in FIGS. 1, 2, and 4. The golf ball marker dispenser 10 also includes a spring 30 secured to the housing 11 and disposed within an inner compartment 32 of the housing 11. The present inventions are not limited to any particular type of spring.

Figure 2:
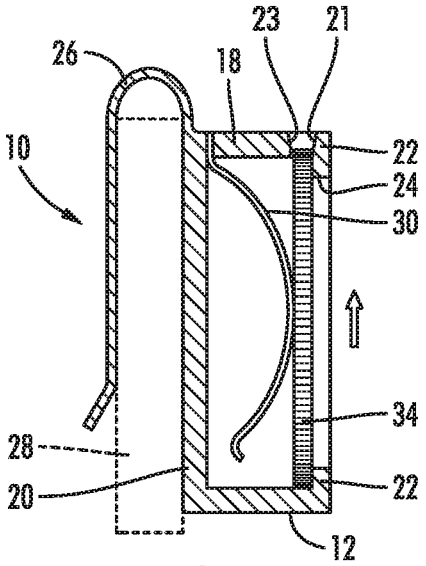
FIG. 2 is another side view similar to FIG. 1 that shows the golf ball marker inserted into and housed within the golf ball marker dispenser.
Figure 3:
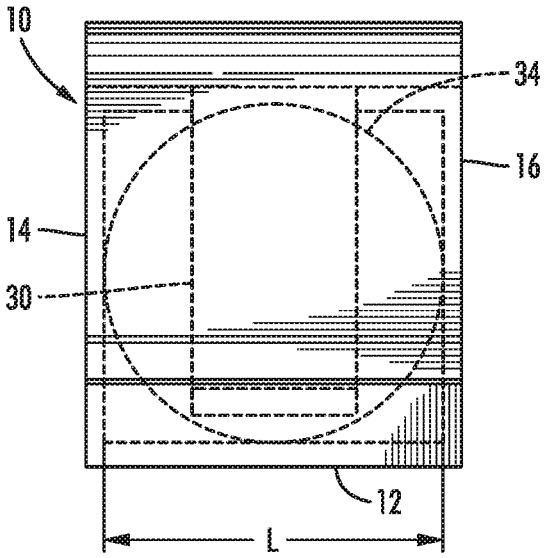
FIG. 3 is another side view showing the back of the golf ball marker dispenser as shown in FIGS. 1 and 2.
Figure 4:
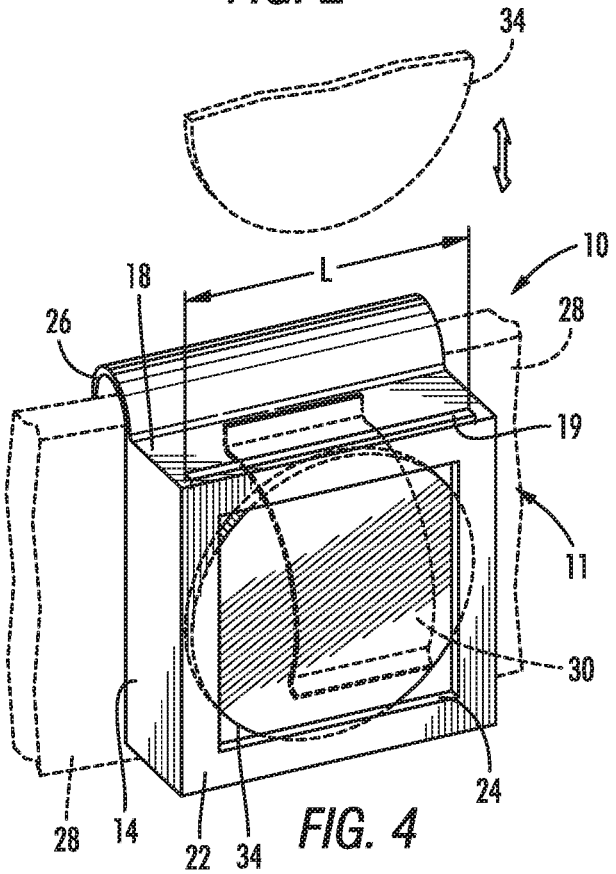
FIG. 4 is a perspective view of the golf ball marker dispenser as shown in FIGS. 1-3.

With reference to FIGS. 1, 2, and 3, the top wall 18 of the housing 11 includes a rectangular slot 19 through which a golf ball marker 34 may be inserted into and removed from the inner compartment 32. The rectangular slot 19 includes a forward wall 21 and a rearward wall 23. In a specific embodiment, the forward and rearward walls 21 and 23 may incline downwardly towards an inner surface 27 of the top wall 18 and towards each other in a funnel-like manner to facilitate insertion of the golf ball marker 34 into the housing 11, as best shown in FIGS. 1 and 2. In a specific embodiment, the golf ball marker 34 may by a circular disc or coin, or any other device of any other desired shape. In a specific embodiment, as shown in FIG. 1, the golf ball marker 34 may have a width W1 and a diameter D. In a specific embodiment, the rectangular slot 19 may be sized to be just slightly larger than the size of the golf ball marker 34, so that the golf ball marker 34 will fit through the rectangular slot 19 with little room for movement, if any, from front to back or side to side when it is being inserted or retrieved through the rectangular slot 19. In a specific embodiment, as shown in FIG. 1, the width W2 of the rectangular slot 19 at the inner surface 27 of the top wall 18 may be just slightly larger than the width W1 of the golf ball marker 36. In a specific embodiment, a length L of the rectangular slot 19 may be just slightly larger than the diameter D of the golf ball marker 34. In a specific embodiment, the length L may also the distance between inner surfaces of the left and right walls 14 and 16.

As best shown in FIGS. 1 and 2, it can be seen that the spring 30 is adapted to urge the golf ball marker 34 against an inside surface or lip 36 of the front wall 22. In a specific embodiment, the opening 24 may define the lip 36 around the opening 24. In a specific embodiment, the forward wall 21 of the rectangular slot 19 may be aligned with the inside surface 36 of the front wall 22 so as to form a continuous surface along which the golf ball marker 34 slides when being inserted into and removed from the housing 11. The manner in which the golf ball marker 34 is engaged with the inside surface 36 of the front wall 22 is further illustrated in FIG. 4. In this regard, the size of the golf ball marker 34 is larger than the opening 24 so that the golf ball marker 34 will not fit through the opening 24, but instead outer portions of the golf ball marker 34 will engage under the force of the spring 30 with the inside surface 36 of the front wall 22.

In a specific embodiment, the spring 30 has a relaxed position, as shown in FIG. 1, and an engaged or flexed position, as shown in FIG. 2. The spring 30 is in its relaxed position when the golf ball marker 34 is not housed within the housing 11, as shown in FIG. 1. The spring 30 is in its engaged or flexed position when it is in contact with the golf ball marker 34 and pressing the golf ball marker 34 against the inside surface of the lip 36 on the front wall 22, as shown in FIG. 2. When the spring 30 is in its relaxed position, as shown in FIG. 1, at least part of the spring 30 must extend into the space in the form of a rectangular prism directly below the rectangular slot 19 in the top wall 18, to insure the spring 30 will contact the golf ball marker 34 when it is inserted through the rectangular slot 19 and into its housed position as shown in FIG. 2. In a specific embodiment, at least part of the spring 30 may extend into the space defined by the opening 24 in the front wall 22 when the spring 30 is in its relaxed position.

Figure 5:
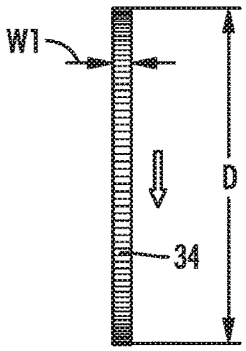
FIG. 5 is a side view similar to FIG. 1 except that FIG. 5 is for another specific embodiment of a golf ball marker dispenser constructed in accordance with another aspect of the present inventions, in which a front opening is round instead of square, as further depicted in FIGS. 6 and 7.
Figure 6:
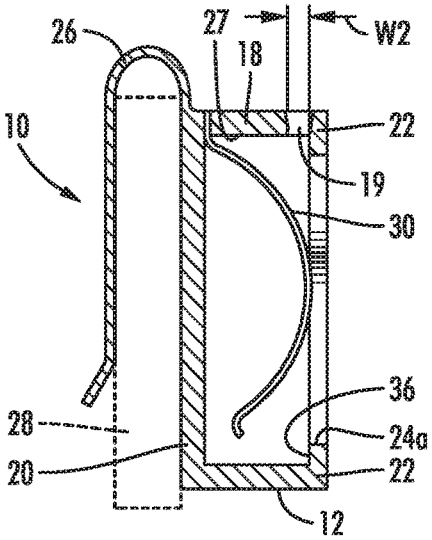
FIG. 6 is a side view similar to FIG. 3, showing the back of the golf ball marker dispenser shown in FIG. 5, in which the front opening is circular instead of square.
Figure 6:
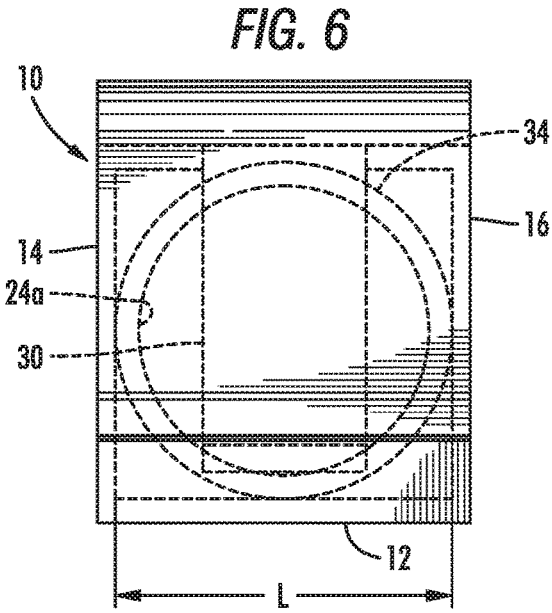
Figure 7:
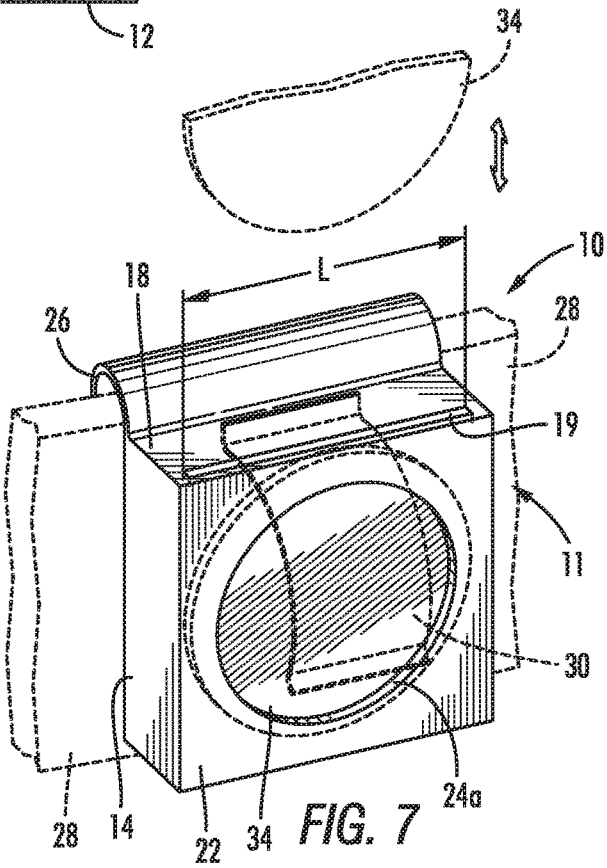
FIG. 7 is a perspective view similar to FIG. 4, showing a perspective view of the golf ball marker dispenser shown in FIGS. 5 and 6, in which the front opening is circular instead of square.

Referring now to FIGS. 5-7, in another specific embodiment of the golf ball marker dispenser 10 of the present inventions, the front wall 22 may be provided with a round or circular opening 24*a*, instead of a square opening 24 as shown in FIGS. 1-4. Other than that one difference, all other aspects of this embodiment are the same as explained above with respect to the embodiment shown in FIGS. 1-4.

In use, the golf ball marker dispenser 10 is attached to a golfer's belt, hat, other item of clothing, or equipment. When the golf ball marker 34 is not in use, it remains housed inside the dispenser housing 11 as shown in FIG. 2. When the golfer is on a putting green and is need of the golf ball marker 34 to mark the position of the golfer's golf ball (not shown), the golfer will place his or her finger through the opening 24/24*a* into contact with the golf ball marker 34, and slide the golf ball marker 34 upwardly through the rectangular slot 19, so as to remove the golf ball marker 34 from the golf ball marker dispenser 10. Then, when it is time for the golfer to putt, the golfer will replace his or her golf ball on the green adjacent the golf ball marker 34, and then pick up the golf ball marker 34 and insert it back through the rectangular slot 19 as shown in FIG. 1, and into its housed position as shown in FIG. 2. As the golf ball marker 34 is inserted into the slot 19, it will slide down the inside surface 36 of the front wall 22 along the inside surface 36 and come into contact with the spring 30 as the golf ball marker 34 is inserted into its housed position. The spring 30 will urge the golf ball marker 34 towards the front wall 22 so as to securely hold the golf ball marker 34 against the inner surface 36 of the front wall 22.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A golf ball marker dispenser comprising:

a housing including a bottom wall, a left side wall, a right side wall, a top wall, a back wall, and a front wall having an opening, the front wall having an inner surface;

a clip attached to the back wall of the housing;

a spring secured to the back wall of the housing and disposed within an inner compartment of the housing;

the top wall of the housing including a rectangular slot through which a golf ball marker may be inserted into and removed from the inner compartment; and, the spring having a relaxed position and an engaged position, the spring being in contact with the golf ball marker when the golf ball marker is housed within the inner compartment of the housing and pushing the golf ball marker against the inner surface of the front wall when the spring is in its engaged position, and the spring extending into a space in the form of a rectangular prism directly below the rectangular slot in the top wall when the golf ball marker is not housed within the inner compartment of the housing and the spring is in its relaxed position.

2. The golf ball marker dispenser of claim 1, wherein the opening in the front wall defines a lip around the opening and the spring pushes the golf ball marker against the lip when the golf ball marker is housed within the inner compartment of the housing.

3. The golf ball marker dispenser of claim 1, wherein the opening is in a geometric shape.

4. The golf ball marker dispenser of claim 1, wherein the opening is in the shape of one of a square and a circle.

5. The golf ball marker dispenser of claim 1, wherein the clip is formed as part of the housing.

6. The golf ball marker dispenser of claim 1, wherein the golf ball marker is in the shape of a circular disc.

7. The golf ball marker dispenser of claim 1, wherein at least part of the spring is positioned in the space defined by the opening in the front wall when the spring is in its relaxed position.

8. The golf ball marker dispenser of claim 1, wherein the rectangular slot includes a forward wall and a rearward wall, each of which inclines downwardly towards each other and toward an inner surface of the top wall, and the forward wall is aligned with the inner surface of the front wall of the housing.

9. A golf ball marker dispenser comprising:

a housing including a bottom wall, a left side wall, a right side wall, a top wall, a back wall, and a front wall having an opening, the front wall having an inner surface;

a clip attached to the back wall of the housing;

a spring secured to the back wall of the housing and disposed within an inner compartment of the housing;

the top wall of the housing including a rectangular slot through which a golf ball marker may be inserted into and removed from the inner compartment, the rectangular slot including a forward wall and a rearward wall, each of which inclines downwardly towards each other and toward an inner surface of the top wall, the forward wall of the rectangular slot being aligned with the inner surface of the front wall of the housing; and, the spring having a relaxed position and an engaged position, the spring being in contact with the golf ball marker when the golf ball marker is housed within the inner compartment of the housing and pushing the golf ball marker against the inner surface of the front wall when the spring is in its engaged position, and the spring extending into a space in the form of a rectangular prism directly below the rectangular slot in the top wall when the golf ball marker is not housed within the inner compartment of the housing and the spring is in its relaxed position.

10. The golf ball marker dispenser of claim 9, wherein the opening in the front wall defines a lip around the opening and the spring pushes the golf ball marker against the lip when the golf ball marker is housed within the inner compartment of the housing.

11. The golf ball marker dispenser of claim 9, wherein the opening is in a geometric shape.

12. The golf ball marker dispenser of claim 9, wherein the opening is in the shape of one of a square and a circle.

13. The golf ball marker dispenser of claim 9, wherein the clip is formed as part of the housing.

14. The golf ball marker dispenser of claim 9, wherein the golf ball marker is in the shape of a circular disc.

15. The golf ball marker dispenser of claim 9, wherein at least part of the spring is positioned in the space defined by the opening in the front wall when the spring is in its relaxed position.

16. A golf ball marker dispenser comprising:

a housing including a bottom wall, a left side wall, a right side wall, a top wall, a back wall, and a front wall having an opening, the front wall having an inner surface;

a clip attached to the back wall of the housing;

a spring secured to the back wall of the housing and disposed within an inner compartment of the housing;

the top wall of the housing including a rectangular slot through which a golf ball marker may be inserted into and removed from the inner compartment;

the spring having a relaxed position and an engaged position, the spring being in contact with the golf ball marker when the golf ball marker is housed within the inner compartment of the housing and pushing the golf ball marker against the inner surface of the front wall when the spring is in its engaged position, and the spring extending into a space in the form of a rectangular prism directly below the rectangular slot in the top wall when the golf ball marker is not housed within the inner compartment of the housing and the spring is in its relaxed position; and the opening in the front wall defining a lip around the opening, the spring being adapted to push the golf ball marker against the lip when spring is in its engaged position and the golf ball marker is housed within the inner compartment of the housing.

17. The golf ball marker dispenser of claim 16, wherein the opening is in a geometric shape.

18. The golf ball marker dispenser of claim 16, wherein the clip is formed as part of the housing.

19. The golf ball marker dispenser of claim 16, wherein at least part of the spring is positioned in the space defined by the opening in the front wall when the spring is in its relaxed position.

20. The golf ball marker dispenser of claim 16, wherein the rectangular slot includes a forward wall and a rearward wall, each of which inclines downwardly towards each other and toward an inner surface of the top wall, and the forward wall is aligned with the inner surface of the front wall of the housing.

21. A golf ball marker dispenser comprising:

a housing including a back wall having a periphery, a front wall having a periphery, and a side wall disposed between the back wall and the front wall, the side wall being disposed adjacent the periphery of the back wall and adjacent the periphery of the front wall, the front wall having an opening and an inner surface;

a clip attached to the back wall of the housing;

a spring secured to the back wall of the housing and disposed within an inner compartment of the housing;

the side wall of the housing including a slot through which a golf ball marker may be inserted into and removed from the inner compartment; and, the spring having a relaxed position and an engaged position, the spring being in contact with the golf ball marker when the golf ball marker is housed within the inner compartment of the housing and pushing the golf ball marker against the inner surface of the front wall when the spring is in its engaged position, and the spring extending into a space directly below the slot in the side wall when the golf ball marker is not housed within the inner compartment of the housing and the spring is in its relaxed position.

22. The golf ball marker dispenser of claim 21, wherein the opening in the front wall defines a lip around the opening and the spring pushes the golf ball marker against the lip when the golf ball marker is housed within the inner compartment of the housing.

23. The golf ball marker dispenser of claim 21, wherein the opening is in a geometric shape.

24. The golf ball marker dispenser of claim 21, wherein the opening is in the shape of one of a square and a circle.

25. The golf ball marker dispenser of claim 21, wherein the clip is formed as part of the housing.

26. The golf ball marker dispenser of claim 21, wherein the golf ball marker is in the shape of a circular disc.

27. The golf ball marker dispenser of claim 21, wherein at least part of the spring is positioned in the space defined by the opening in the front wall when the spring is in its relaxed position.

28. The golf ball marker dispenser of claim 21, wherein the slot includes a forward wall and a rearward wall, each of which inclines downwardly towards each other and toward an inner surface of the side wall, and the forward wall is aligned with the inner surface of the front wall of the housing.

29. A golf ball marker dispenser comprising:

a housing including a back wall having a periphery, a front wall having a periphery, and a side wall disposed between the back wall and the front wall, the side wall being disposed adjacent the periphery of the back wall and adjacent the periphery of the front wall, the front wall having an opening and an inner surface;

a clip attached to the back wall of the housing;

the back wall having a spring extending toward the front wall and into an inner compartment of the housing;

the side wall of the housing including a slot through which a golf ball marker may be inserted into and removed from the inner compartment; and, the spring having a relaxed position and an engaged position, the spring being in contact with the golf ball marker when the golf ball marker is housed within the inner compartment of the housing and pushing the golf ball marker against the inner surface of the front wall when the spring is in its engaged position, and the spring extending into a space directly below the slot in the side wall when the golf ball marker is not housed within the inner compartment of the housing and the spring is in its relaxed position.

30. The golf ball marker dispenser of claim 29, wherein the opening in the front wall defines a lip around the opening and the spring pushes the golf ball marker against the lip when the golf ball marker is housed within the inner compartment of the housing.

31. The golf ball marker dispenser of claim 29, wherein the opening is in a geometric shape.

32. The golf ball marker dispenser of claim 29, wherein the opening is in the shape of one of a square and a circle.

33. The golf ball marker dispenser of claim 29, wherein the clip is formed as part of the housing.

34. The golf ball marker dispenser of claim 29, wherein the golf ball marker is in the shape of a circular disc.

35. The golf ball marker dispenser of claim 29, wherein at least part of the spring is positioned in the space defined by the opening in the front wall when the spring is in its relaxed position.

36. The golf ball marker dispenser of claim 29, wherein the slot includes a forward wall and a rearward wall, each of which inclines downwardly towards each other and toward an inner surface of the side wall, and the forward wall is aligned with the inner surface of the front wall of the housing.

* * * * *